United States Patent [19]

Merl

[11] Patent Number: 5,026,129

[45] Date of Patent: Jun. 25, 1991

[54] MERCHANDISE DISPLAY ASSEMBLY

[75] Inventor: Milton Merl, New York, N.Y.

[73] Assignee: Marlboro Marketing, Inc. D/B/A TH Howard Marlboro Group, New York, N.Y.

[21] Appl. No.: 477,065

[22] Filed: Feb. 7, 1990

[51] Int. Cl.[5] ..... A47B 49/06

[52] U.S. Cl. ..... 312/266; 312/319; 312/121; 312/248

[58] Field of Search ..... 312/266, 269, 248, 319, 312/120, 121, 123, 124, 323; 211/170, 189.1, 99

[56] References Cited

U.S. PATENT DOCUMENTS

| | | | |
|---|---|---|---|
| 1,227,892 | 5/1917 | Darby | 312/121 |
| 2,635,030 | 4/1953 | Stebbins et al. | 312/266 X |
| 4,076,351 | 2/1978 | Wyant | 312/325 X |

*Primary Examiner*—Joseph Falk
*Attorney, Agent, or Firm*—Darby & Darby

[57] ABSTRACT

Merchandise display assembly including a vertical bin having an upper filling opening and a lower dispensing opening, mounted by a suspension linkage on brackets attached to a vertical support structure, to swing the bin outwardly and downwardly from an upper storage position at which the bin rear is adjacent the support structure and the lower opening is at a height at which merchandise items in the bin can be readily removed by a consumer, to a lower filling position at which the bin rear is outwardly spaced from the support structure and the upper opening is at a height at which such items can be readily filled thereinto, while maintaining the bin vertical in any movement position thereof. The bin is usable with a merchandise display tray such as an outwardly and downwardly inclined gravity feed drawer, connected to the support structure therebelow, such that the bin when in upper position permits opening of the drawer for unhindered loading of merchandise items at its rear portion, and when in lower position for loading the bin with its items outwardly clears the closed drawer.

16 Claims, 4 Drawing Sheets

MERCHANDISE DISPLAY ASSEMBLY

FIELD AND BACKGROUND OF THE INVENTION

The present invention relates to a merchandise display assembly, and more particularly to a such an assembly having a bin swingable from an upper horizontally recessed storage position at which merchandise items contained therein are within the normal reach of consumers, to a lower horizontally extended filling position at which such items can be readily loaded into the bin, yet when in lower position outwardly clearing another merchandise display unit such as a tray in the space therebelow and when in upper position upwardly clearing the tray for consumer access to its merchandise items.

The usual merchandise display unit used for dispensing lightweight bulky and often fragile ingredients such as salted snacks, e.g. potato chips, or other chip, snack, peanut, etc. salted snack category merchandise items, requires a large space in the consumer shopping area of supermarkets or other retail stores. This is because these items are of the "flex-bag" type, i.e. relatively large volume individual packages, often filled with air in hermetically sealed condition to avoid crushing of the contents and loss of commercial attractiveness.

While these items should desirably be arranged for maximum attractive display and ready access by consumers in retail stores, it is important that the unit use efficiently the lateral display area, i.e. the lateral or horizontal width along the store aisle, to hold as many items as possible. This is because the usual retail store allots only a limited amount of shelf space to each category of merchandise along the aisle, and since the usable shelf depth is fixed, while the usable height is limited to a range no higher generally that consumer eye level or consumer reach, that space must be efficiently used within its laterally constricting allotted width.

A major inherent problem with the merchandising of these salted snacks is that most of these items, in general, are more in the nature of low profit commodities and less identified by feature product or superior value attributes. Traditionally, situations exist in retailing around the world where these commodity products take up 50, 60 or even 70% of the physical volume of the salted snack category, but contribute proportionally less, e.g. 20, 30 or 40%, to profit.

In addition, these products, which may be termed "over-spaced" products, are prone to reaching early out-of-stock condition, in that fewer packages can be stored in a given display space and thus more frequent restocking is necessary. Even though these items are overspaced relative to profit, they are still not well spaced enough for merchandising efficiency.

While newer, premium products and products that can potentially grow and expand the size of this category for increased profitability, such as peanuts, tree nuts, dried fruits, and like specialty items, are becoming more prevalent, other small, denser, superior products are often relegated to secondary and underspaced positions relative to the space apportioned in the retail store to this category of merchandise.

It is clear from the above that a need exists for an improved merchandise display arrangement to overcome these drawbacks, and particularly to rearrange these bulky commodity products within the lateral confines of the space alloted to this product category in the retail store and in effect create additional space that allows for adequate featuring of the premium products as well, that can potentially expand this product category for increased profitability.

SUMMARY OF THE INVENTION

It is an object of this invention to overcome prior art drawbacks, and to provide a merchandise display assembly permitting more efficient use of the entire available space allotted to the displaying and dispensing of a given category of product in a retail store or similar establishment, both as to full merchandising exploitation of the available lateral width of the display space and its potentially usable height, while enabling different types of consumer products, such as commodity products and premium products, in that category to be displayed and dispensed in conjunction with each other for maximum sale of all such products within the alloted space and improved profitability as to all such products.

It is another object of this invention to provide such an assembly which is simple and inexpensive in construction, readily fabricated, easily erected, and robust and long wearing in use.

According to this invention, a merchandise display assembly is provided which comprises a vertical bin having a front side and a rear side, an upper opening for filling the bin with dispensable merchandise items, and a lower opening at the front side for manual removal of the items from the bin, plus bracket means adapted to be attached to a vertical support structure, and a suspension linkage for mounting the bin vertically on the bracket means.

The linkage effectively mounts the bin on the bracket means for swinging movement of the bin forwardly outwardly and downwardly from an upper storage position at which the rear side is at a horizontally recessed point adjacent the bracket means and the lower opening is at a vertical dispensing level at which the items can be readily removed therefrom, to a lower filling position at which the rear side is at a horizontally extended point spaced a selective distance forwardly outwardly from its horizontal recessed point and the upper opening is at a vertical loading level at which the items can be readily filled thereinto, while maintaining the bin vertical in any position of such swinging movement.

Counterbalancing means such as loaded spring means are favorably provided for normally urging the linkage to swing the bin to upper position.

In particular, the linkage includes lever means having stationary pivot means fixed to the bracket means and floating pivot means spaced a selective distance from the stationary pivot means and fixed to the bin for swinging movement of the lever means about the stationary pivot means and of the bin about the floating pivot means.

The lever means may include a normally vertical lever having a stationary pivot at a lower end thereof fixed to the bracket means and a floating pivot at an upper end thereof spaced a selective distance from the stationary pivot and fixed to the bin so that the floating pivot vertically overlies the stationary pivot, the lever being swingable about the stationary pivot to move the floating pivot to a lower level at which the lever is inclined to the vertical and the floating pivot is forwardly outwardly spaced from the stationary pivot to move the bin from upper to lower position.

More specifically, the bin has opposed lateral sides, and the bracket means include a bracket at each lateral side of the bin, and the lever means include a lever at each bracket and fixed at a stationary pivot thereof to the bracket and fixed at a floating pivot thereof to the adjacent bin lateral side, with a counterbalancing means being provided at each lever for normally urging the lever to vertical position to swing the bin to upper position.

The lever means preferably includes a pair of coacting parallel lever bars at each bracket and fixed at a corresponding pair of parallel stationary pivots thereof to the bracket and fixed at a corresponding pair of parallel floating pivots thereof to the adjacent lateral side of the bin to form a parallelogram lever and pivot linkage. The lever bars are arranged to abut each other laterally at a selective point of such swinging movement to prevent further movement thereof upon swinging the bars to move the bin from upper to lower position.

The lower opening of the bin is conveniently a rearwardly recessed vertical opening extending laterally along the bin front side and is provided at its upper margin with an overlying horizontally rearwardly extending ledge to prevent items in the bin from directly reaching the lower opening. The bin also has a closed forwardly and downwardly inclined bottom side forming a gravity feed surface adjacent the lower opening to aid dispensing of the items, and the lower opening is provided at its lower margin with a vertically extending lip to prevent items adjacent the inclined bottom side from falling out through the lower opening.

According to a combination feature of the invention, a vertical support structure is provided for the bin which also has connected thereto a separate counterpart, horizontal open tray for displaying other merchandise items therein and forwardly outwardly terminating in a front edge. The bracket means are attached to the support structure to mount the bin vertically via the linkage so that when the bin is at upper position its rear side is closely adjacent the support structure while the lowermost bin portion is spaced a selective height vertically above the tray, and when the bin is at lower position its rear side is forwardly outwardly spaced from both the support structure and the front edge of the tray.

The bin has a closed forwardly and downwardly inclined bottom side forming a gravity feed surface adjacent the lower opening to aid dispensing of the items, and the tray has a forwardly and downwardly inclined top side equidistantly spaced below the bin bottom side, and containing a forwardly and downwardly inclined gravity feed dispensing system for advancing remaining items toward the tray front edge when a more forwardly located item is removed from the tray.

In particular, the tray includes a pair of opposed vertically extending lateral walls connected to and extending forwardly outwardly from the support structure and containing a corresponding pair of drawer slides pivotally connected thereto about a laterally extending horizontal pivot, and a forwardly and downwardly inclined drawer having a front end with a retaining lip and a rear end adjacent the support structure.

The drawer is slidably mounted on the slides and pivotable with the slides relative to the walls about the horizontal pivot to raise the drawer front end, and a stop on at least one of the walls normally retainingly engages the drawer front end, such that the drawer is liftable at its front end over the stop by upward movement about the horizontal pivot to release the drawer for forwardly outward movement to an extended position at which the rear end is disposed at least adjacent the bin front side when in upper position, to permit unhindered filling of the drawer with items adjacent its rear end.

The gravity feed system includes forwardly and downwardly inclined linear guides extending from the rear end to the front end of the drawer and weighted pusher members having guideways for slidably engaging the guides to urge items in the drawer toward its front end.

BRIEF DESCRIPTION OF THE DRAWINGS

Other objects of the invention will become apparent from the within specification and accompanying drawings, in which.

DESCRIPTION OF THE PREFERRED EMBODIMENTS

Figure 2:
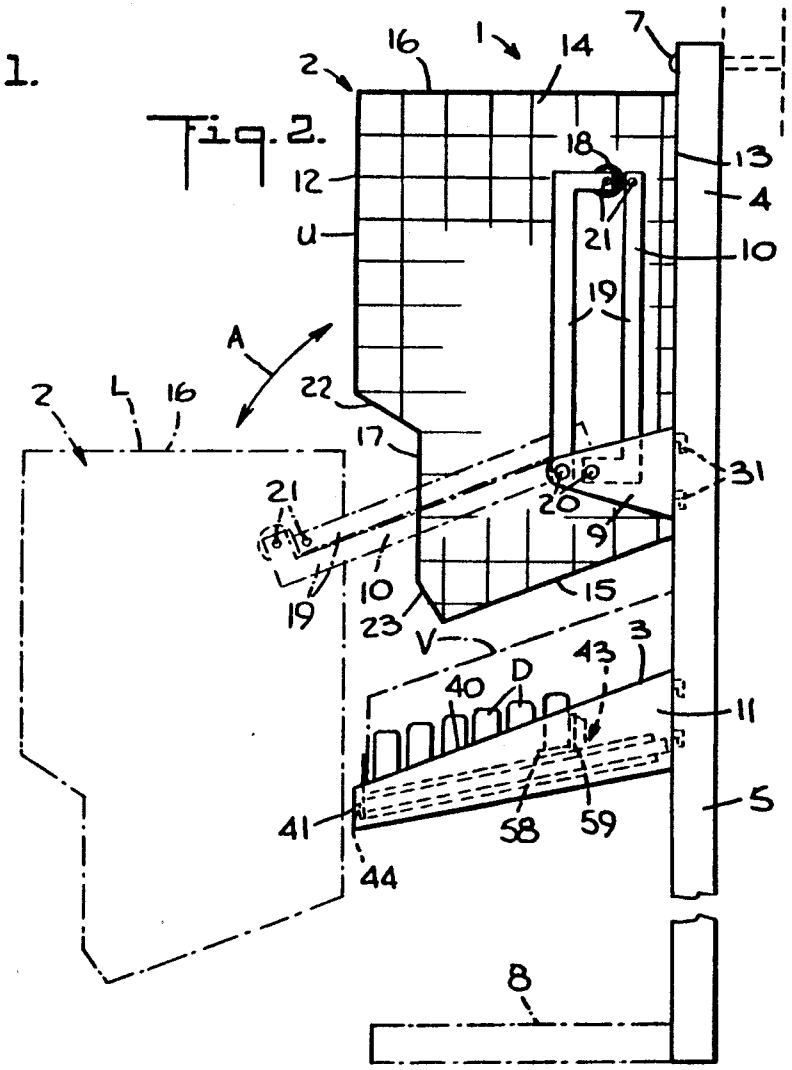
FIGS. 1 and 2 are schematic front and side elevational views, respectively, of a merchandise display assembly according to an embodiment of the invention, including an upper swingable bin and a lower stationary tray, formed as a drawer, with both the bin and tray being mounted in vertically successive order on a vertical support structure.
Figure 1:
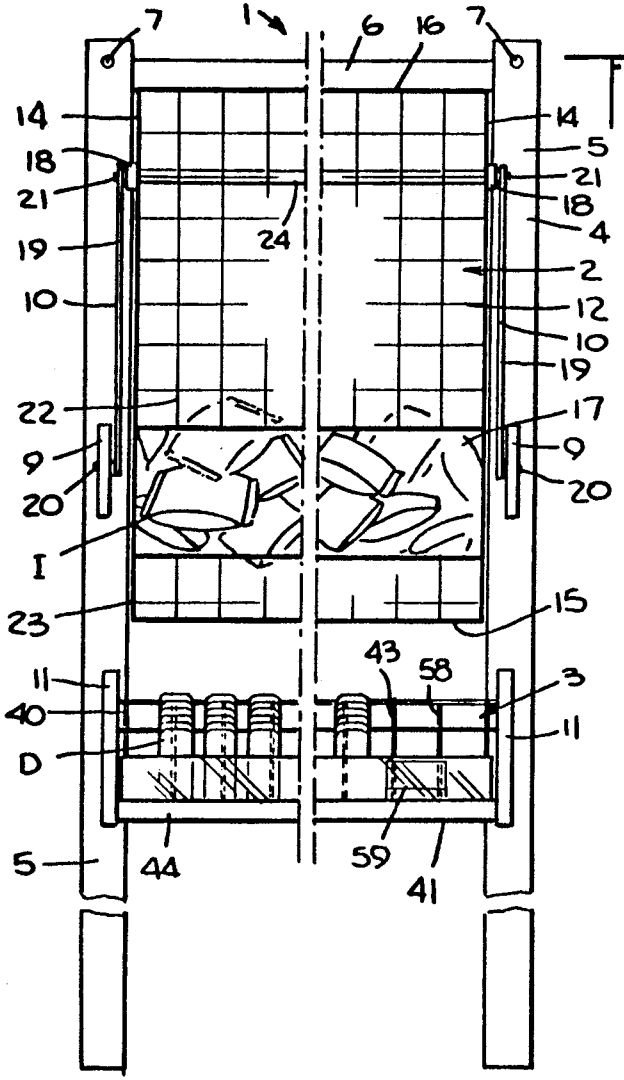

Referring to the drawings, and initially to FIGS. 1–2, a merchandise display assembly 1 is shown, which includes an upper vertical closed bin 2, e.g. of open wire mesh construction, and a lower outwardly and downwardly inclined upwardly open tray 3, e.g. in the form of a drawer, mounted on a vertical structural support 4. Support 4 is formed in conventional manner of a pair of laterally spaced apart columns 5 interconnected by a panel 6, and this type support structure as used in retail stores is often referred to as a gondola.

Structure 4 may be bolted to a wall or other permanent structure in a retail shopping area by bolts 7 or the like, or may be provided with floor engaging feet 8 (shown in phantom) to form a self-standing unit.

Bin 2 is mounted on support 4 by side brackets 9,9 and suspension linkages 10,10, and tray 3 is mounted on support 4 by side walls 11,11, such that the usable volume V (shown in phantom) of tray 3 is spaced downwardly of bin 2 a selective distance to permit unhindered access to the randomly arranged gravity feed, bulky package items I (shown in phantom), e.g. potato chip bags or other "flex-bag" product of commodity quality, in bin 2, as well as unhindered access to the orderly arranged, upstanding and front-facing, gravity feed, denser package items D, e.g. small bags of premium quality nuts, in tray 3.

Bin 2 has a vertical front side 12, a vertical rear side 13, opposed vertical lateral sides 14,14, a closed forwardly and downwardly inclined bottom side 15, an open upper side forming an upper loading hopper or filling opening 16 for loading bin 2 with the dispensable merchandise items I, and a lower opening 17 at front side 12 for manual removal of items I from bin 2 by the consumer.

Linkages 10 mount bin 2 vertically on brackets 9 for swinging movement of bin 2 in the direction of arrow A forwardly outwardly and downwardly from an upper storage position U at which rear side 13 is at a horizontally recessed point adjacent brackets 9 and support 4, and lower opening 17 is at a vertical dispensing level, e.g. eye level, at which the items I can be readily removed therefrom by a consumer, to a lower filling position L (shown in phantom in FIG. 2) at which rear side 13 is at a horizontally extended point spaced a selective distance forwardly outwardly from its horizontally recessed point, and upper opening 16 is at a vertical loading level, e.g. eye level, at which items I can be readily filled thereinto by a store attendant.

During such swinging movement of bin 2, linkages 10 maintain the bin generally vertical throughout, i.e. in any position of such swinging movement. To aid return of a loaded bin 2 from lower position L to upper position U, linkages 10 are each provided with counterbalancing means, such as loaded coil leaf springs 18,18. By preloading springs 18, linkages 10 are normally urged to swing bin 2 back to upper position U with reduced effort by the store attendant.

Linkages 10 include lever means having stationary pivot means fixed to brackets 9 and floating pivot means spaced a selective distance from the stationary pivot means and fixed to bin 2 for swinging movement of the lever means about the stationary pivot means and of bin 2 about the floating pivot means.

In particular, these linkage means contemplate a normally vertical lever having a stationary pivot at a lower end thereof fixed to a corresponding bracket 9 and a floating pivot at an upper end thereof spaced a selective distance from the stationary pivot and fixed to bin 2 so that the floating pivot generally vertically overlies the stationary pivot, the lever being swingable about the stationary pivot to move the floating pivot in the direction of arrow A to a lower level at which the lever is inclined to the vertical and the floating pivot is forwardly outwardly spaced from the stationary pivot to move bin 2 from upper position U to lower position L.

Preferably, the lever means or levers include a pair of coacting parallel lever bars 19,19, e.g. of L-shaped profile, at each bracket 9, which are fixed at a corresponding pair of parallel stationary pivots 20,20 to the adjacent brackets 9, and which are fixed at a corresponding pair of parallel floating pivots 21,21 to the adjacent lateral sides 14 of bin 2, so as to form a parallelogram lever and pivot linkage system.

Figure 3B:
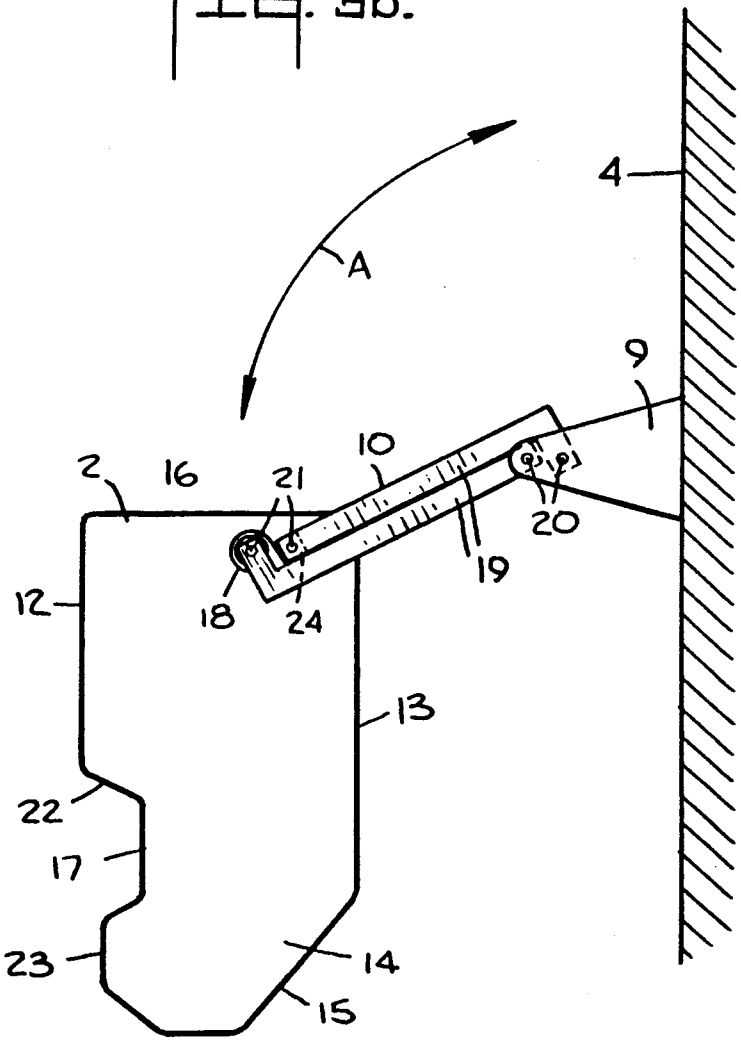
FIGS. 3*a* and 3*b* are schematic views of the swingable bin in upper storage position and lower filling position, respectively, in relation to the support structure.
Figure 3A:
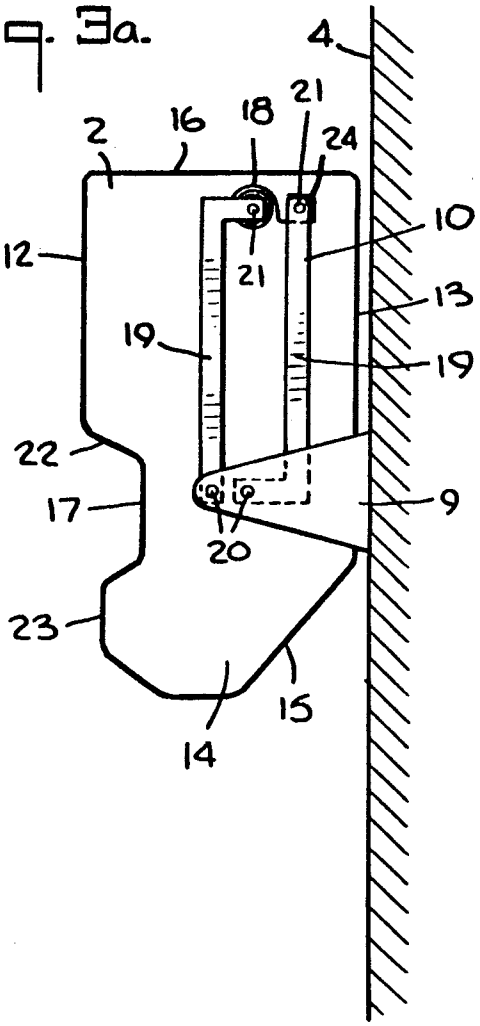

As shown only symbolically in phantom in FIG. 2, and schematically more clearly in FIGS. 3*a* and 3*b* in which bin 2 is depicted in approximate profile, bars 19 are preferably arranged to abut each other laterally (FIG. 3*b*) at a selective point of the swinging movement in the direction of arrow A from upper position U (FIG. 3*a*) so as to prevent further movement thereof and thereby defining the lower position L (FIG. 3*b*), i.e. upon swinging bars 19 to move bin 2 from upper to lower position.

Favorably, lower opening 17 is a rearwardly recessed vertical opening that extends laterally along front side 12, and is provided at its upper margin with an overlying generally horizontally rearwardly extending ledge 22 to prevent items I in bin 2 from directly reaching lower opening 17. Ledge 22 serves to bear the weight of the overlying items I and prevent clogging or jamming of items I at lower opening 17.

Also, inclined bottom side 15 is desirably formed as a gravity feed sliding surface adjacent lower opening 17 to aid dispensing of items I, and the lower margin of lower opening 17 is provided with a generally vertically extending lip 23 to prevent items I adjacent inclined bottom side 15 from falling out through lower opening 17.

Figure 4:
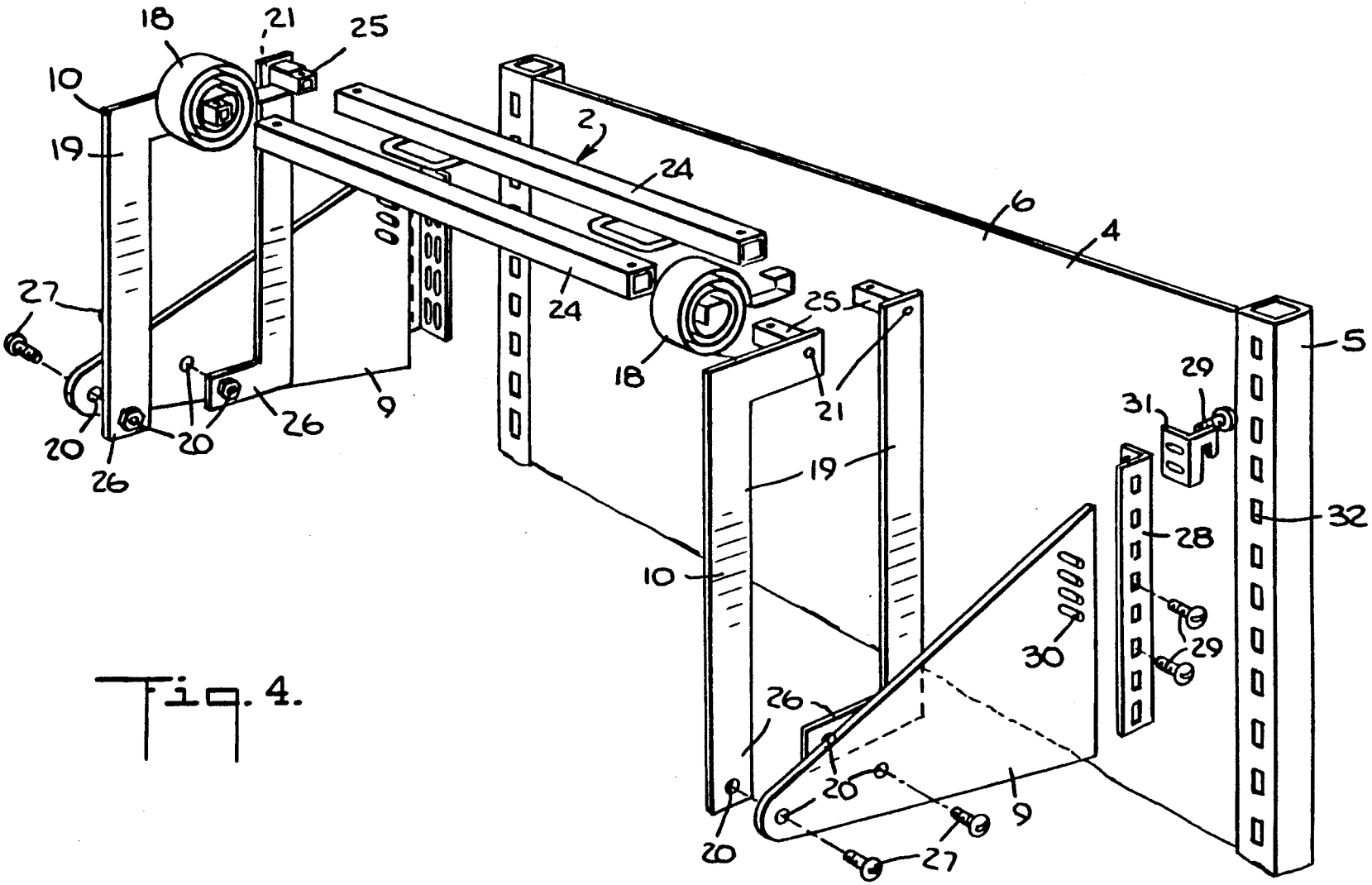
FIG. 4 is an exploded perspective view of part of the bin of FIGS. 1–2, showing its mounting on the support structure.

FIG. 4 shows the construction and arrangement of linkages 10, including bars 19, stationary pivots 20, floating pivots 21, and springs 18, in relation to their connection to brackets 9 and bin 2, the latter being represented by crossbars 24,24 (cf FIG. 1) passing through the open mesh construction of bin 2 at the upper portion thereof to mount floating pivots 21 thereon. Crossbars 24 are conveniently of square tubular construction to permit insertion of counterpart telescoping square tubular construction floating pivot ends 25, 25 of bars 19, whereas the stationary pivot ends 26,26 of bars 19 are suitably fixed to brackets 9 by pivot connector pins 27,27.

The square tubular construction of coacting parts 24 and 25 enables coil leaf springs 18 to be mounted at the appropriate floating pivots 21 without the need for a special keeper to maintain them in proper seated condition for play-free operative preloaded resilient counterbalancing action. Of course, any other suitable counterbalancing system may be used to achieve the resilient counterforce and/or constant physical load counterweight operative biasing of linkages 10 to urge them in the upward direction of arrow A for normally returning bin 2 back to or keeping bin 2 at upper position U.

Brackets 9 are also suitably provided with angle members 28 to which they are adjustably attached by screws 29 or the like fitting in bracket inclined slots 30, angle members 28 in turn being attached by further screws 29 to hook clips 31 which engage in vertical slots 32 in columns 5 to mount brackets 9 adjacent panel 6 on support 4 in conventional manner (FIG. 4).

Upwardly open tray 3 is favorably forwardly outwardly and downwardly inclined to display its merchandise contents to best advantage, and thus conveniently has a forwardly and downwardly inclined top side 40 which provides for accommodating items D in tray 3 in orderly arranged, upstanding and front-facing, disposition within the confines of tray volume V. At the same time, tray 3 is sized relative to bin 2 such that it forwardly outwardly terminates in a front edge 41 which is located generally vertically below bin front side 12, e.g. in vertical alignment therewith or even extending slightly outwardly of front side 12 for more immediate consumer access to items D thereon (FIG. 2).

This distance of front edge 41 from support 4 is related to the linkage 10 composite radial distance from the parallel stationary pivots 20 to the parallel floating pivots 21 of parallel level bars 19, and the extent of the pivotal arc path of travel in the direction of arrow A from the vertical disposition of bars 19 to their inclined disposition in laterally abutting contact with each other when bin 2 swings from upper position U to lower position L, whereby when bin 2 is at lower position L its rear side 13 is forwardly outwardly spaced not only from support 4 but also from front edge 41 of tray 3 sufficiently to clear tray 3 at least by a nominally small horizontal increment.

Since the lowermost portion of bin 2 is spaced a selective height vertically above tray 3, and is conveniently provided with a forwardly and downwardly inclined bottom side 15, and since tray 3 is likewise formed with a forwardly and downwardly inclined top side 40, tray 3 is suitably positioned on support 4 such that top side 40 is generally equidistantly spaced below bin bottom side 15. This facilitates use in tray 3 of a forwardly and downwardly inclined gravity feed, positive dispensing system 43 for advancing remaining items D toward tray front edge 41 when a more forwardly located item D is removed by a consumer from tray 3, thus insuring first-in, first-out dispensing of items D (FIGS. 1–2).

Figures 5, 6, 7:
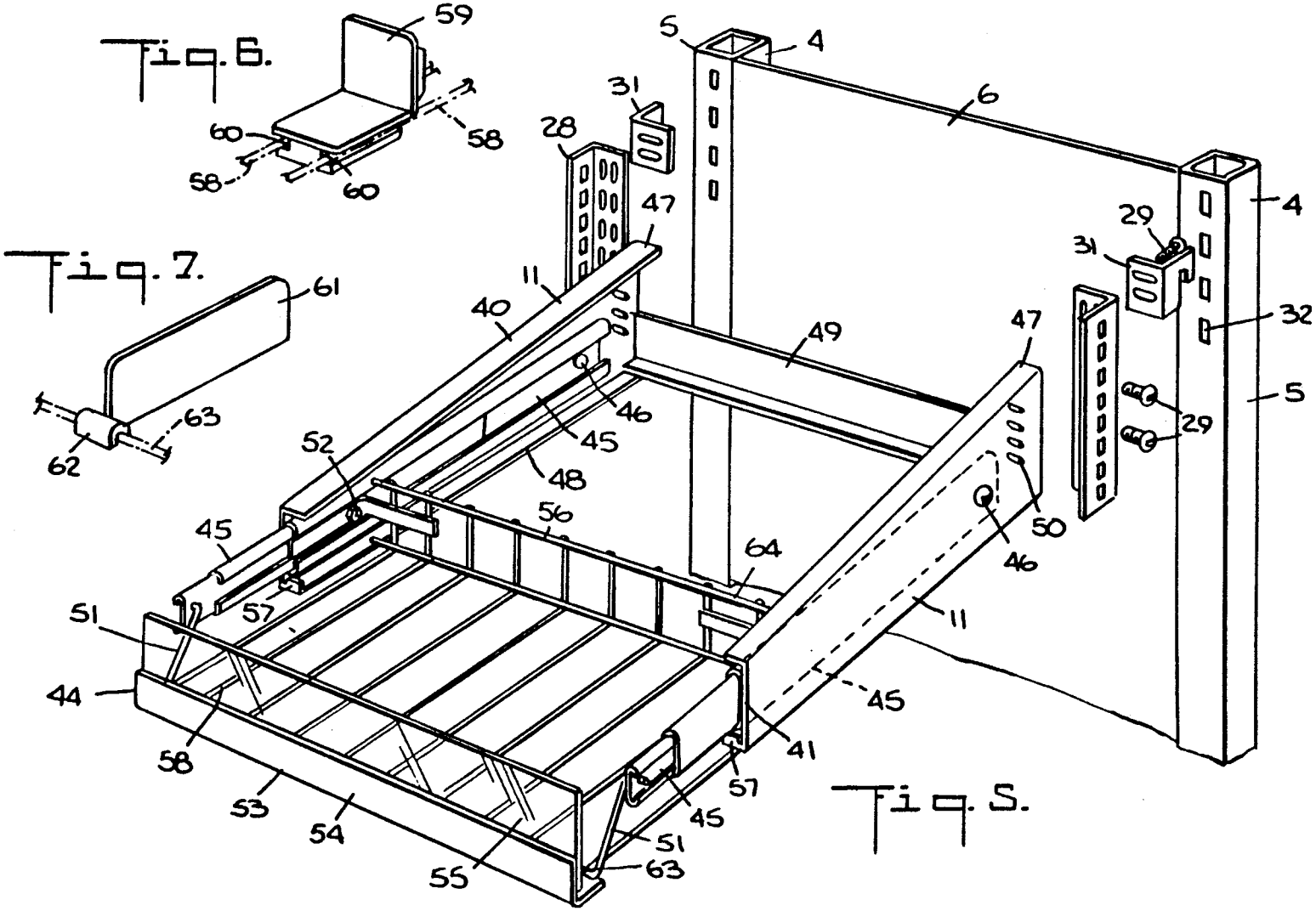
FIG. 5 is an exploded perspective view of the tray of FIGS. 1–2, similarly showing its mounting on the support structure.
FIG. 6 is a perspective view of a merchandise item gravity feed pusher member used in the tray of FIG. 5.
FIG. 7 is a perspective view of a merchandise item divider used in the tray of FIG. 5.

As shown more clearly in FIG. 5, tray 3 is provided in the form of a forwardly and downwardly inclined pull-out drawer 44 mounted on the pair of opposed vertically extending lateral walls 11 by conventional expandable telescoping drawer slides 45,45 pivotally connected at their rear end portions to the rear portions of walls 11 about a laterally extending generally horizontal pivot axis defined by pivots 46,46. Walls 11 are of similar construction to bin brackets 9 but may be longer, and preferably have inwardly directed upper flanges 47,47 and lower flanges 48,48 for added strength and to accommodate the lateral sides of drawer 44 within their track-like linear confines, as well as a laterally reinforcing rear crossbar 49.

FIG. 5 further shows the construction and arrangement of walls 11 in relation to columns 5 and panel 6 of support 4. Like brackets 9, walls 11 are also suitably provided with angle members 28 to which they are adjustably attached by screws 29 or the like fitting in wall inclined slots 50, with angle members 28 in turn being attached by further screws 29 to hook clips 31 which engage in vertical slots 32 in columns 5 to mount walls 11 the desired distance vertically below brackets 9 on support 4 in conventional manner.

Drawer 44 is suitably attached by front connections 51,51 and rear connections 52,52 to slides 45 for common outward and inward movement therewith relative to stationary walls 11. The front end 53 of drawer 44 has an upwardly directed retaining lip 54, and favorably also has an upwardly directed vertical plate 55, e.g. of glass or clear plastic, connected at lip 54 and extending laterally along the width of drawer 44, for retaining items D therein in orderly arrangement as well as in full view for attractive presentation of items D to the consumer. The rear end of drawer 44 is suitably formed as an upwardly directed rear wall 56 which is normally adjacent support 4 when drawer 44 is in closed disposition.

The front ends of walls 11 are provided with stops 57,57 for normally retaining inclined drawer 44 in closed disposition by contact with lip 54. Thus, to open drawer 44, the store attendant need merely lift front end 53 over stops 57 by upward movement about pivots 46 to release the drawer for forwardly outward movement relative to walls 11 and support 4 to an extended position. This step is undertaken, of course, when bin 2 is at upper position U (FIG. 2). Suitable retaining means (not shown) may also be provided, e.g. on walls 11, to engage a rear portion of drawer 44 when extended to prevent its unintended complete removal or dislodgement from walls 11, as the artisan will appreciate.

When drawer 44 is at extended position, rear end wall 56 is disposed generally at least adjacent front side 12 of bin 2, i.e. when bin 2 is at upper position U, but may extend farther outwardly than front side 12 or even less than the horizontal point of front side 12, depending on the horizontal dimensions of brackets 9 and walls 11, and bin lateral sides 14, and of the distance between drawer front end 53 and rear wall 56. These dimensions and distances will be selected to permit unhindered filling of drawer 44 with items D, not merely in the vicinity of front end 53 but more desirably in the vicinity of rear wall 56.

This is because drawer 44 is preferably intended to hold premium quality items D, especially edibles having a comparatively short shelf life in terms of freshness of product, and gravity feed system 43 is designed to favor consumer selection of the frontmost items D in drawer 44, so that in refilling drawer 44, the store attendant will add replacement items D at the rear of drawer 44 for more uniform dispensing of items D in succession, thus assuring a more constant fresh condition of the product inventory in this part of the display assembly.

For this purpose, gravity feed system 43 may be provided in the form of a series of forwardly and downwardly inclined laterally spaced apart parallel linear guides 58, e.g. wires, extending from rear wall 56 to front end 53 of drawer 44, on which individual weighted pusher members 59 having laterally opposed guideways 60,60, as shown in FIG. 6, may be mounted for sliding engagement between guideways 60 and an adjacent pair of guides 58. Being weighted, a given pusher member 59 will urge toward front end 53 those items D in a given front to back row of upstanding and front-facing such items resting on adjacent guides 58 in drawer 44.

In this regard, to segregate these side by side rows of items D, as shown in FIG. 7, a corresponding series of side by side drawer dividers 61 may be arranged in front to back alignment in drawer 44, e.g. with their front ends having a laterally extending grooved clip 62 for mounting engagement with a front crosswire 63 joining the front ends of guides 57 in drawer 44, the rear ends thereof being jointed by a raised rear crosswire 64 forming a part of rear wall 56 (FIG. 5). Dividers 61 may be of a height conforming collectively to the composite height of volume V on tray 3 (FIG. 2).

In fact, drawer 44 is conveniently formed mainly of guides 57 and crosswires 63 and 64 as a kind of cage suspended via connectors 51 and 52 on slides 45, thereby providing a relatively light-weight yet strong construction.

Typically, bin 2 may be about 100 cm (39.37 in) in lateral width along the retail store aisle, about 60 cm (23.62 in) in transverse depth to panel 6, and about 90 cm (35.4 in) in height between open top end 16 and closed bottom wall 15, with lower opening 17 having a vertical open height of about 23.2 cm (9.13 in) and with its upper margin located about 34.4 cm (13.53 in) from bottom wall 15 and its lower margin located about 11.2 cm (4.4 in) from bottom wall 15.

In conjunction therewith, tray 3 or drawer 44 may have a lateral width of also about 100 cm, a height of about 18 cm at the rear end of walls 11, and may extend in horizontal direction about 54 cm, such than when drawer 44 is in extended position, the horizontal direction length is increased at least about 40–50 cm to about 90–104 cm. This size drawer is able to accommodate about 36 kilograms of the contemplated premium product as items D.

Support 4, as a conventional gondola, may also be about 100 cm in lateral width, and is usually about 200 cm in height. This permits bin 2 to be mounted thereon so as to place lower opening 17 at about eye level height when bin 2 is at upper position U for ready access to items I by the consumer, and to place its open top filling opening 16 at about the same eye level height when bin 2 is at lower position L for ready access to fill bin 2 with replacement items I through top opening 16 (FIGS. 3*a* and 3*b*). At the same time, this permits tray 3 to be positioned on support 4 a suitable vertical distance below bin 2 so that there is adequate clearance between the volume V of items D on tray 3 and the bottom side 15 of bin 2.

Bin 2 may be provided with dividers (not shown), similar to drawer dividers 61, vertically disposed in the interior of bin 2 in side by side laterally spaced apart parallel relation to prevent jamming of items I and allow for their more uniform travel through the hopper-like bin 2 from upper opening 16 to lower opening 17 and for more uniform successive removal, so as to avoid dead spaces in bin 2 and assure more constant dispensing of items I in their order of addition, i.e. in terms of first-in, first-out consumption of inventory, with a view to maintaining freshness of product by the hopper-like gravity feed supplying of items I to the consumer via lower opening 17.

Of course, other overall widths, depths and heights for bin 2, tray 3 and support 4 may be used, as desired, so long as bin 2 clears tray 3 when moved to lower position L and provides the desired access by the consumer to items I at lower opening 17 when bin 2 is at upper position U and by the store attendant to upper opening 16 for filling bin 2 when at lower position L, and also provides room below bottom side 15 of bin 2 for access by the consumer to items D on tray 3 as well as sufficient height between bin 2 and tray 3 for appropriate display of items D on the tray.

Bin 2 and tray 3 are favorably composed metal parts, but may be made of other materials such as plastic, so long as sufficient structural strength is provided to achieve the functional purposes of assembly 1 and its individual components. Assembly 1 may be shipped in knocked down form and readily assembled on site by attachment to a given support 4, as shown in FIGS. 4 and 5.

The present invention thus provides a merchandise display assembly permitting more efficient use of the available display area in a compact manner, since the main portion of the height of bin 2 when in upper position U is stored in an otherwise unused space above eye level, enabling the portion of the space below eye level to be used, not for storing large and bulky commodity items I, but instead for displaying and dispensing small premium items D in tray 3. The main part of the inventory of bulky commodity items I that inherently take up a large space is placed in a relatively large bin 2 normally occupying the otherwise unused upper vertical space above eye level when in upper position U, more or less out of sight.

Nevertheless, the portion of front side 12 of bin 2 immediately above lower opening 17 is available for posting merchandising information or the like, e.g. on a suitable sign attached to bin 2 thereat.

This leaves available under bin 2 when in upper position U a significant lateral width space near eye level height for direct display of premium small size items D on tray 3 immediately in front of the consumer.

Whereas in the past, these premium items D were usually merely dumped on a shelf or tray in random unattractive order, losing all visual identity and prone to uneven dispensing of old and fresh product alike, inclined tray 3 provides an attractive orderly display of premium items D and dispensing system 43 assures upstanding and front-face, high-visibility and identity, presentation of items D as well as first-in, first-out dispensing thereof, with ready access to the rear of tray 3 when in extended position to restock it with fresh items D to be dispensed in turn after the previous inventory of items D thereon has been selected by the consumer.

Thus, both bin 2 and tray 3 are designed to assure first-in, first-out or rotation dispensing of their displayed items, and on-going product freshness, as well as easy access for dispensing and for restocking. Consequently, storing of both types of items in the same space will tend to increase their selection by the consumer for more efficient space-to-profit utilization of this category of retail store items. It is estimated that this arrangement of bin 2 and tray 3 will increase volume by as much as 30%, while avoiding premature out-of-stock condition, for better use of the available store space and potential growth of sales of this category of product.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Merchandise display assembly, comprising a vertical bin movable between an upper storage position and a lower filling position, and having a front side and a rear side, an upper side defining an open top surface forming an upwardly facing upper opening for downwardly filling the bin with dispensable merchandise items when the bin is in lower filling position, and a lower opening at the front side for manual removal of the items from the bin when the bin is in upper storage position, bracket means adapted to be attached to a generally vertical support structure, and a suspension linkage for mounting the bin vertically on the bracket means for arcuate path swinging movement of the bin forwardly outwardly and downwardly from an upper storage position at which the rear side is at a horizontally recessed point adjacent the bracket means and the lower opening is at an upper vertical dispensing level at which the items can be readily removed therefrom, to a lower filling position at which the rear side is at a horizontally extended point spaced a selective distance forwardly outwardly from its horizontal recessed point and also spaced forwardly outwardly from the bracket means and the upper opening is at a lower vertical loading level at which the items can be readily filled thereinto, while maintaining the bin generally vertical in any position of such arcuate path swinging movement.

2. Assembly of claim 1 wherein counterbalancing means are provided for normally urging the linkage to swing the bin to upper position.

3. Assembly of claim 2 wherein the counterbalancing means include loaded spring means.

4. Assembly of claim 1 wherein the linkage includes lever means having stationary pivot means fixed to the bracket means and floating pivot means spaced a selective distance from the stationary pivot means and fixed to the bin for swinging movement of the lever means about the stationary pivot means and of the bin about the floating pivot means.

5. Merchandise display assembly, comprising a vertical bin having a front side and a rear side, an upper opening for filling the bin with dispensable merchandise items, and a lower opening at the front side for manual removal of the items from the bin, bracket means adapted to be attached to a generally vertical support structure, and a suspension linkage for mounting the bin vertically on the bracket means for swinging movement of the bin forwardly outwardly and downwardly from an upper storage position at which the rear side is at a horizontally recessed point adjacent the bracket means and the lower opening is at a vertical dispensing level at which the items can be readily removed therefrom, to a lower filling position at which the rear side is at a horizontally extended point spaced a selective distance forwardly outwardly from its horizontal recessed point and the upper opening is at a vertical loading level at which the items can be readily filled thereinto, while maintaining the bin generally vertical in any position of such swinging movement, the linkage including lever means having stationary pivot means fixed to the bracket means and floating pivot means spaced a selective distance from the stationary pivot means and fixed to the bin for swinging movement of the lever means about the stationary pivot means and of the bin about the floating pivot means, and the lever means including a normally vertical lever having a stationary pivot at a lower end thereof fixed to the bracket means and a floating pivot at an upper end thereof spaced a selective distance from the stationary pivot and fixed to the bin so that the floating pivot generally vertically overlies the stationary pivot, the lever being swingable about the stationary pivot to move the floating pivot to a lower level at which the lever is inclined to the vertical and the floating pivot is forwardly outwardly spaced from the stationary pivot to move the bin from upper to lower position.

6. Assembly of claim 5 wherein the bin has opposed lateral sides, the bracket means include a bracket at each lateral side of the bin, and the lever means include a said lever at each bracket and fixed at a stationary pivot thereof to the bracket and fixed at a floating pivot thereof to the adjacent lateral side of the bin.

7. Assembly of claim 6 wherein a counterbalancing means is provided at each lever for normally urging the lever to vertical position to swing the bin to upper position.

8. Assembly of claim 6 wherein the lever means includes a pair of coacting parallel lever bars at each bracket and fixed at a corresponding pair of parallel stationary pivots thereof to the bracket and fixed at a corresponding pair of parallel floating pivots thereof to the adjacent lateral side of the bin to form a parallelogram lever and pivot linkage.

9. Assembly of claim 8 wherein the lever bars are arranged to abut each other laterally at a selective point of such swinging movement to prevent further movement thereof upon swinging the bars to move the bin from upper to lower position.

10. Assembly of claim 9 wherein a counterbalancing loaded spring means is provided at each pair of lever bars for normally urging the bars to swing the bin to upper position.

11. Assembly of claim 1 wherein the lower opening is a rearwardly recessed vertical opening extending laterally along the front side of the bin and is provided at its upper margin with an overlying generally horizontally rearwardly extending ledge to prevent items in the bin from directly reaching the lower opening.

12. Assembly of claim 11 wherein the bin has a closed forwardly and downwardly inclined bottom side forming a gravity feed surface adjacent the lower opening to aid dispensing of the items, and the lower opening is provided at its lower margin with a generally vertically extending lip to prevent items adjacent the inclined bottom side from falling out through the lower opening.

13. Merchandise display assembly, comprising a vertical bin movable between an upper storage position and a lower filling position, and having a front side and a rear side, an upper side defining an open top surface forming an upwardly facing upper opening for downwardly filling the bin with dispensable merchandise items when the bin is in lower filling position, and a lower opening at the front side for manual removal of the items from the bin when the bin is in upper storage position, bracket means adapted to be attached to a generally vertical support structure, a suspension linkage for mounting the bin vertically on the bracket means for arcuate path swinging movement of the bin forwardly outwardly and downwardly from an upper storage position at which the rear side is at a horizontally recessed point adjacent the bracket means and the lower opening is at an upper vertical dispensing level at which the items can be readily removed therefrom, to a lower filling position at which the rear side is at a horizontally extended point spaced a selective distance forwardly outwardly from its horizontal recessed point and the upper opening is at a lower vertical loading level at which the items can be readily filled thereinto, while maintaining the bin generally vertical in any position of such arcuate path swinging movement, and a generally vertical support structure having connected thereto a separate counterpart, generally horizontal open tray for displaying other merchandise items therein and forwardly outwardly terminating in a front edge, the bracket means being attached to the support structure to mount the bin vertically via the linkage so that when the bin is at upper position its rear side is closely adjacent the support structure while the lowermost portion of the bin is spaced a selective height vertically above the tray sufficiently to permit direct access to the tray, and when the bin is at lower position its rear side is forwardly outwardly spaced from both the support structure and the front edge of the tray, and so that the bin is spaced from the tray in any position of such arcuate path swinging movement.

14. Assembly of claim 13 wherein the bin has a closed forwardly and downwardly inclined bottom side forming a gravity feed surface adjacent the lower opening to aid dispensing of the items, and the tray has a forwardly and downwardly inclined top side generally equidistantly spaced below the bin bottom side, and containing a forwardly and downwardly inclined gravity feed dispensing system for advancing remaining items toward the tray front edge when a more forwardly located item is removed from the tray.

15. Assembly of claim 14 wherein the tray includes a pair of opposed vertically extending lateral walls connected to and extending forwardly outwardly from the support structure and containing a corresponding pair of drawer slides pivotally connected thereto about a laterally extending generally horizontal pivot, and a forwardly and downwardly inclined drawer having a front end with a retaining lip and a rear end adjacent the support structure, and being slidably mounted on the slides and pivotable with the slides relative to the walls about the horizontal pivot to raise the drawer front end, and a stop on at least one of the walls normally retainingly engaging the drawer front end, the drawer being liftable at its front end over the stop by upward movement about the horizontal pivot to release the drawer for forwardly outward movement to an extended position at which the rear end is disposed generally at least adjacent the front side of the bin when in upper position, to permit unhindered filling of the drawer with items adjacent its rear end.

16. Assembly of claim 15 wherein the gravity feed system includes forwardly and downwardly inclined linear guides extending from the rear end to the front end of the drawer and weighted pusher members having guideways for slidably engaging the guides to urge items in the drawer toward its front end.

* * * * *